US006409500B2

(12) United States Patent
Georgantas

(10) Patent No.: US 6,409,500 B2
(45) Date of Patent: Jun. 25, 2002

(54) GLASS FIRE AND METHOD OF MAKING

(76) Inventor: Mark T. Georgantas, 2141 Venitia, Tustin, CA (US) 92782

( * ) Notice: Subject to any disclaimer, the term of this patent is extended or adjusted under 35 U.S.C. 154(b) by 0 days.

(21) Appl. No.: 09/841,620

(22) Filed: Apr. 23, 2001

Related U.S. Application Data

(63) Continuation-in-part of application No. 09/386,579, filed on Aug. 30, 1999, now abandoned.

(51) Int. Cl.[7] ..... F24C 3/04; F24C 3/00

(52) U.S. Cl. ..... 431/125; 431/326; 431/328; 431/7; 126/500; 126/503; 126/512

(58) Field of Search ..... 431/7, 125, 126, 431/326, 328; 126/500, 512, 503

(56) References Cited

U.S. PATENT DOCUMENTS 1,074,110 A * 9/1913 Fyfe
3,322,179 A * 5/1967 Goodell
3,583,845 A * 6/1971 Pulone
4,890,601 A * 1/1990 Potter

FOREIGN PATENT DOCUMENTS

GB 1541423 * 2/1979
JP 58140344 * 8/1983

OTHER PUBLICATIONS

"The Earth Sciences", 2nd Edition, Arthur n. Strahler, Columbia University, Harper & Row, pp. 343–353.*

* cited by examiner

*Primary Examiner*—Carl D. Price
(74) *Attorney, Agent, or Firm*—James G. O'Neill

(57) ABSTRACT

A process and product for producing an attractive soot-free fire from a specially formed gas pipe embedded in a bed of broken, specially-formulated, tempered glass pieces is provided. The broken glass pieces are preferably formed from a specifically-formulated, tempered glass which, after formation, is broken and then sifted and washed so as to remove any slivers or debris. The gas pipe is preferably formed with two rows of equally spaced openings offset with respect to each other and spaced approximately 90° apart to burn gas in a cleaner and hotter manner. A number of gas pipes may be used and formed in any desired configuration to add to the attractiveness of the soot-free fire produced thereby.

17 Claims, 2 Drawing Sheets

GLASS FIRE AND METHOD OF MAKING

CROSS-REFERENCE TO RELATED APPLICATIONS

This application is a continuation-in-part of application Ser. No. 09/386,579 now abandoned, filed Aug. 30, 1999.

BACKGROUND OF THE INVENTION

1. Field of the Invention

This invention relates generally to gas fires, and, more particularly, to an improved substantially soot-free gas fire produced in a fireplace by forming a bed of broken, tempered glass, and utilizing one or more specifically formed gas pipes that burn hotter and cleaner.

2. Description of Related Art

Many types of simulated coal, log or gas fireplace devices are known. For example, U.S. Pat. No. 1,604,850 to Payne discloses an illusion device using a screen, formed from transparent or semi-transparent material, such as mica or glass. The mica or glass is shaped into small panels or windows held in frames to simulate a bed of coals. The screens are mounted on a frame, and a gas pipe is mounted under the frame. When the gas pipe is lit, an illusion of a coal fire is formed by the screens. However, there is no disclosure or teaching in this patent, of utilizing a bed of glass made from shattered or broken tempered glass supported on the base of a fireplace, and having a gas pipe of a specific design in the glass bed.

U.S. Pat. No. 5,656,558 to Brix et al. discloses hard glass fire retardant glasses, which can be tempered in a conventional air-tempering plant, having specific heat transmission values. However, there is no disclosure in this patent of breaking the hard glass, and then using such broken, tempered glass in a fireplace to form an attractive fire therein.

U.S. Pat. No. 3,671,175 to Campbell discloses a fireplace log burner, having a centrally disposed gas outlet held in an elongated trough-like body with granular refractory material held therein for distributing and burning the gas. The granular refractory material held in the trough-like body is disclosed as being course gravel expanded vermiculite, pearlite, or the like, may be used to aid burning logs held over the trough-like device. No disclosure of broken, tempered glass in a bed to form an attractive fire is found in this patent.

U.S. Pat. No. 4,110,063 to Mitchell discloses a heating appliance operated from a gaseous fuel, having a plurality of refractory bodies simulating solid fuel, mounted on the top of a distributor for the gaseous fuel. The simulated solid fuel bodies, when heated, glow to provide the appearance of glowing coals. A U-shaped tube is positioned in a holding tray containing a bed of particulate refractory materials, such as sand. The refractory bodies are supported on the bed of sand. However, no mention is made in this patent of the type of gas pipes used, or the forming of the gas pipe to other shapes, nor is there any disclosure therein of having substantially soot-free flames appearing on the top of a bed of glass supported within a fireplace.

U.S. Pat. No. 4,233,348 to Corry discloses a method for producing and a product thus produced using raw ceramic bulk fibers to produce imitation coals for use in a fireplace grate. This patent also lacks a disclosure or teaching of using a bed of broken, tempered glass to produce an attractive fire of the present invention.

Further U.S. Pat. No. 4,306,537 to Mitchell, U.S. Pat. No. 4,573,905 to Meyers, U.S. Pat. No. 3,582,250 to Chatfield, U.S. Pat. No. 4,828,485 to Jankowski and U.S. Pat. No. 4,890,601 to Potter disclose other gas burners or simulated gas fires, but do not disclose specific elements of the glass fire and method of the present invention, or the type of gas pipes used to form a substantially soot-free fire. Furthermore, such patents do not disclose the use a valve in the gas pipe, to control the color and other attributes of the flame by using a remote control unit.

SUMMARY OF THE INVENTION

Accordingly, it is a general object of the present invention to provide an improved gas fire in a fireplace. It is a particular object of the present invention to provide an improved soot-free gas fire. It is a further particular object of the present invention to provide an improved soot-free glass fire, and method of making. It is another particular object of the present invention to provide an improved soot-free gas fire, comprised of a bed of broken, specially-formulated, tempered glass pieces formed around a gas pipe. It is yet another particular object of the present invention to provide a method of forming an improved substantially soot-free gas fire made from specially-formulated, tempered glass pieces, which tempered glass pieces are made from glass that has been baked three times in a temperature and oxygen controlled environment, whereby, when the tempered glass is broken, the size and shape of the pieces obtained thereby is controlled. It is a still further object of the present invention to provide an improved substantially soot-free gas fire using a bed of broken, specially-formulated, tempered glass pieces having a specifically-formed gas line therein, which gas line has special "v" drilled openings formed therein to provide a hotter, cleaner-burning flame which is soot-free and provides a more pleasing appearance. And, it is still yet another particular object of the present invention to provide an improved method for making a substantially soot-free gas fire in which tempered glass, baked three times in a controlled temperature and oxygen environment over a predetermined period of time, is broken to form smooth-edged pieces. The formed pieces of the broken, tempered glass may be washed and sifted to remove any debris, and may be further abraded or polished to form glass pieces without sharp edges, if needed, and when used with the specially formed gas pipe is not changed in color and appearance.

These and other objects and advantages of the present invention are achieved by providing a bed of glass pieces in the base of a fireplace, which bed of glass has pieces made from specially-formulated, broken, tempered glass. The broken pieces are tightly packed around a gas line in the fireplace, in a desired configuration. The gas line is specially formed by drilling offset or staggered holes at approximately 45°, in two rows creating a "v" formation, approximately 90° apart on a top surface of one or more gas pipes. The gas pipes may also be formed into any desired configuration to provide an aesthetically pleasing-shaped fire over the bed of glass pieces.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

Figure 1:
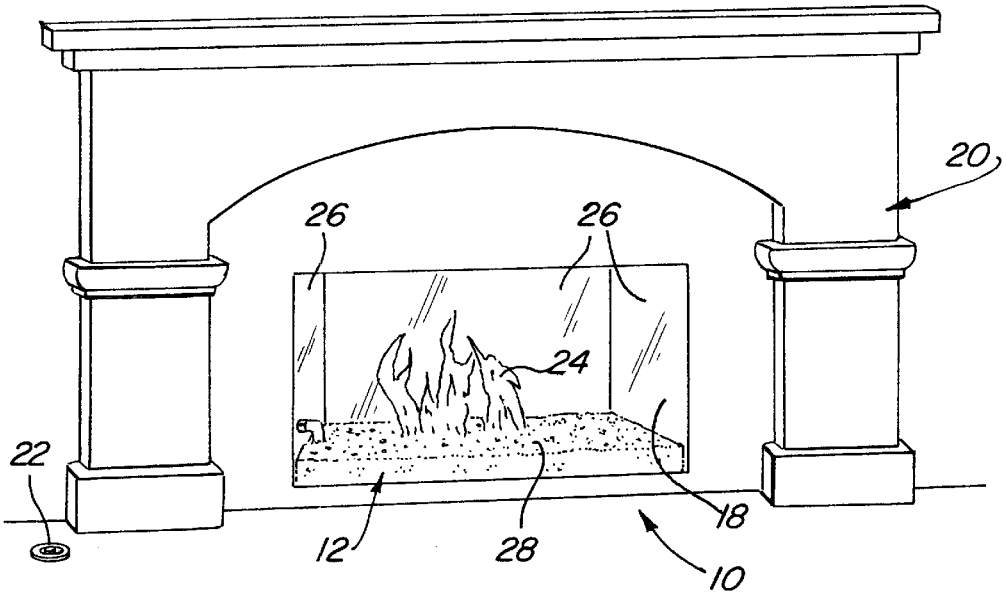
FIG. 1 is a front elevational view of a fireplace having a bed of glass pieces of the present invention, held therein around a gas line, and showing an aesthetically pleasing fire over the top surface of the glass.
Figure 2:
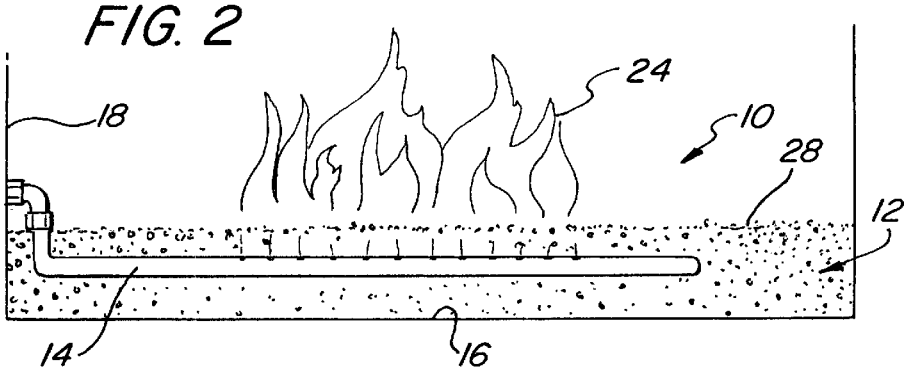
FIG. 2 is an enlarged cross sectional view through the bed of glass pieces of FIG. 1, showing a gas line or gas pipe buried within the glass pieces.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved gas fire and method of making by utilizing a bed of specially-formulated, broken glass pieces with a specially formed gas line buried therein to form an attractive and aesthetically pleasing, soot-free fire near and above the top surface of the bed of glass pieces.

Turning now to the drawings, there shown is a gas fire 10, comprised of a bed of broken glass pieces 12, described more fully below, formed by packing, around a gas line 14, and supported by a base, or other supporting surface, 16 in an opening 18 in a fireplace 20, with or without a flue, and/or a chimney. When gas is turned on, as by operating a valve 22 in a known manner, and the gas lit in the bed of broken glass pieces 12, flames 24 are formed near and over the top surface of the bed 12 to produce an attractive and aesthetically-pleasing soot-free fire, which appears to float over the top of the glass bed, and produces a myriad of sparkles in the non-hazardous broken pieces of the glass bed, but does not cause soot, nor change the color or appearance of the glass bed. The interior surfaces or walls of the fireplace opening 18 may be provided with mirrors 26, held in place on the walls by an adhesive, to produce further reflections and/or sparkles from the glass bed and flames 24, thereby enhancing its attractiveness.

The bed of broken glass pieces 12 is preferably formed from broken pieces of specially-formulated, tempered glass. The specially-formulated tempered glass comes from modified lime-soda float glass having most of the iron taken out of it or a borosilicate glass. Either glass is preferably from 2.5 mm to 20 mm in thickness, and is baked at least three times at temperatures of about 1200° F. for 30 minutes or more, followed by rapid cooling of the outer surfaces via controlled air blasts or an oil-water cooling process, while the center is allowed to cool slowly. This achieves a highly desirable state of surface compression between 10,000 and 13,500 psi, perfectly balanced by internal tension, that produces a certain amount of bow or wrap in the formed glass, which bow or wrap is associated with each piece of broken glass formed therefrom. The formed glass has improved resistance to rapid temperature changes and impacts, plus a fracture pattern yielding small, relatively harmless fragments of approximately the same size, without hazardous jagged edges and shards, when broken into pieces. The broken pieces of the tempered glass are about 10 mm in size and contain few, if any, sharp edges. Furthermore, because of the bow and wrap, they may produce distorted reflected images under certain viewing conditions that actually improves the specular reflectance. To insure that no sharp edges or slivers remain, the broken pieces of tempered glass may be washed and then sifted to remove debris. In this manner, a bed of glass is formed from smooth pieces, which pieces are approximately the same size, and which will allow gas to flow around the pieces to allow flames to be formed near and over the top surface 28 by burning gas from the gas line 14.

When the glass is properly and tightly packed around a gas pipe, for example, in a wedge, mounded flat, or a beveled manner, the rounded pieces of the bed of glass 12 will produce a myriad of sparkles from the flames 24 burning near and over the top 28 of the bed. Furthermore, no appreciable soot or color change will occur and no heat build-up will take place in the glass bed, whereby the hand of a person may be placed on the top 28 of the bed, without fear of burning. Additionally, when the hot, clean flames 24 are burning, any mirrors 26 within the opening 18 will produce additional reflections and sparkles to add to the attractiveness of the fire.

Figure 3:
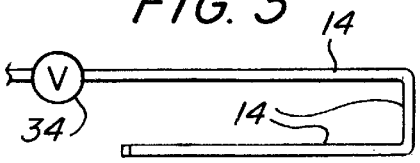
FIG. 3 is a top plan view of a U-shaped gas line, which is buried in the glass bed of the present invention.
Figure 4:
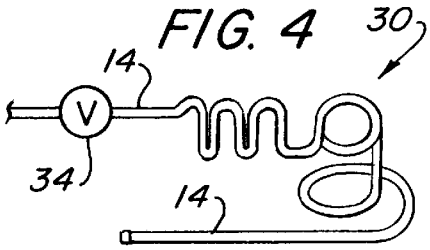
FIG. 4 is a top plan view of a further configuration of a decorative gas line that is buried in the glass bed of the present invention.
Figure 5:
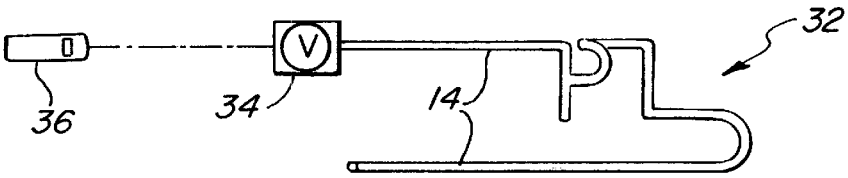
FIG. 5 is a top plan view of a still further configuration of a decorative gas line; having a remote-control-operated valve for varying the oxygen-fed to the gas line, and varying the color of the flames produced thereby.

As shown in FIGS. 3–5 of the drawings, the color, shape and configuration of the flames 24 within the fireplace over the top 28 of the glass bed 12 may be controlled by shaping the pipe 14 into a U-shaped pipe, as shown in FIG. 3, or initials, as shown in FIGS. 4 and 5 at 30, 32. It is to be understood, that the gas line 14 may be formed in any desired shape allowable with hollow pipe, such as a crest, a monogram, a heart shape, a circle, a square, a triangle, or the like, depending on the desired effect to be achieved by a user.

Moreover, the oxygen content of the gas entering the pipe 14 may be modified by actuation of a valve 34, such as a flap valve, or the like, via a remote control 36, such as an infrared remote control. The remote control 36 will control the opening and closing of valve 34, to vary the gas supply and thus the color of the flame.

The flames 24 will, of course, be more visible at night or in a darkened room. Normally, the flames 24 have the appearance of floating near or over the top surface 28 of the bed of glass pieces 12. Both the bed of glass pieces 12 and any mirrors 26, if used, will sparkle and reflect the flames to thereby enhance its effect. Furthermore, as described above, the color of the flames 24 may be controlled, by operation of the valve 34 via the remote control 36.

Figure 6:
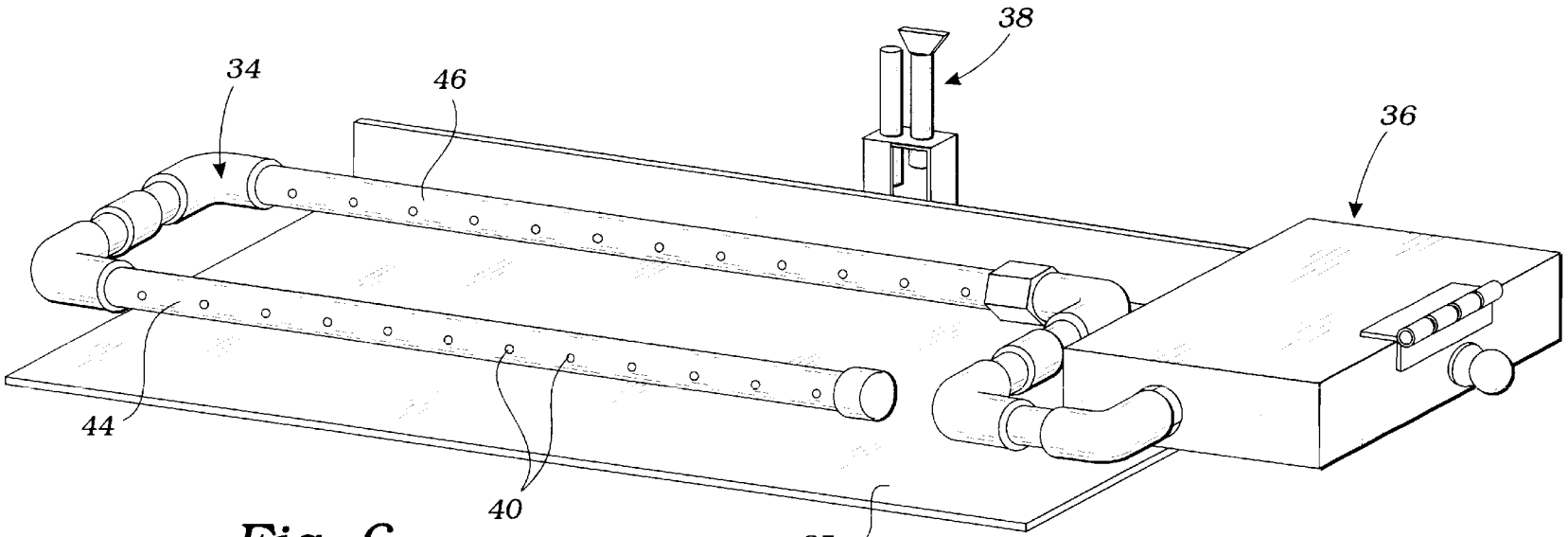
FIG. 6 is a perspective view of a U-shaped gas line having "v" drilled offset or staggered holes in two rows on both pipes and connected to a control box having a remote-control-operated valve and a pilot light connected thereto.
Figure 7:
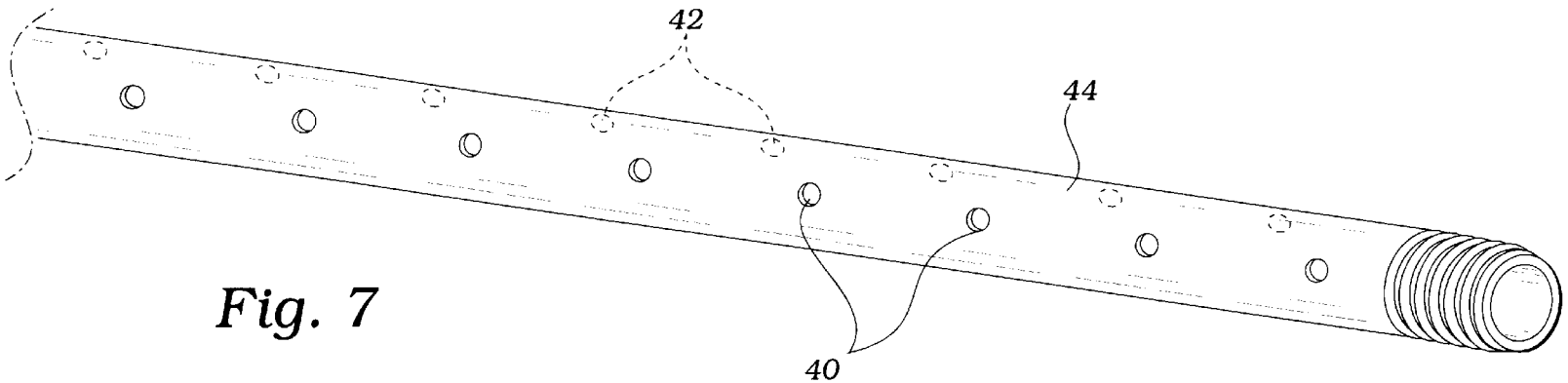
FIG. 7 is an enlarged perspective view of a one of the gas pipes of FIG. 6 showing the "v" drilled holes alternating or staggered on opposite sides of the top of the pipe, approximately 90° apart.

As shown in FIGS. 6 and 7 of the drawings, the flames 24 formed within the fireplace near and over the top 28 of the glass bed 12 are preferably controlled by providing a U-shaped gas pipe 34, mounted on a pan or plate 35 and connected to a control box 36. A pilot light 38 may be utilized, if required by state or local law. The U-shaped gas pipe 34 includes two rows of equally spaced drilled openings 40, 42, positioned approximately 90° apart on the top of each gas pipe 44, 46. As best shown in FIG. 7, the two rows of holes 40, 42 are offset or staggered to provide better, cleaner and hotter-burning characteristics. That is, the two rows of staggered holes allow more substantial soot-free burning of gas in a bed of glass, without changing the color or appearance of the glass bed. Depending on the length of each pipe 44, 46 in the U-shaped configuration, and the rating of the same, the number and size of the holes 40, 42 in each row vary. For example, the pipes may be from 8" to 60" long, with an 18" pipe having 24 holes in two rows of 12 equally spaced holes positioned 90° apart. Each hole would be approximately 0.125" in diameter and would be staggered 0.66" from row to row. A 24 inch long pipe would have a total of thirty three equally spaced holes equally staggered at 0.66" spacing, with one row having 17 holes, while the other has 18. A 36" long pipe could have a total of fifty two 0.125" holes divided into two rows of 26 equally spaced holes, with the holes in each row having a 0.66" stagger.

To ensure that a soot-free fire is obtained and that the bed of glass pieces does not change in color and appearance when gas is burned therein, the gas pipes used should also be as clean as possible, and not having a paint or the like thereon that has oils that would burn or create soot. The gas pipes used in the present invention are preferably washed in a special sulfuric acid bath (H2SO4) to rid the pipes of oils and paints. The cleaned pipes are then dipped in or painted with a zinc phosphate solution (ZnPO4) to resist heat and eliminate any oxidation or rust. The zinc phosphate coated soot-free burning gas pipes of the present invention have been approved by CSA—Canadian Standards Association International (formerly AGA—American Gas Association) and no other soot-free burning gas pipe product such as this is available, nor has any ever been approved by or seen by the CSA/AGA.

Different size openings can be used in the pipes to regulate the flow of gas burned so as to provide cleaner, controlled, soot-free gas fires with ratings of from 100,000 Btus to 75,000 Btus. Additionally, one embodiment of the invention, rated at 40,000 Btus has been qualified by the CSA/AGA as VENT FREE, therefore, requiring no chimney or the like, where used.

It, therefore, can be seen that an improved soot-free gas fire is provided by forming a bed of specially-formulated, broken, tempered glass pieces on the base or a further flat surface in a fireplace around a specially formed gas line that produces a fire that does not cause soot, or change the color or appearance of the glass pieces. The glass fire of the present invention provides aesthetically pleasing soot-free flames and sparkles without the dirt, smoke and soot that is normally associated with burning a log, other gas fires, or other materials in a fireplace. And, although the flames will give off substantial heat, they will not appreciably heat the bed of glass itself, thereby allowing the surface thereof, away from the flames, to be touched, if desired.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A gas fire formed in a fireplace, comprising:

the fireplace having an opening, a supporting surface and a plurality of rear walls;

at least one gas pipe having two rows of openings therein held in the fireplace above the supporting surface to burn gas in soot-free flames; and a bed of broken glass pieces formed from broken, tempered glass that is baked three times, and subject to sudden surface cooling, held on the supporting surface in the fireplace and surrounding the at least one gas pipe to allow the soot-free flames to burn near and over top of the bed of broken glass pieces without changing the color or appearance of the bed of broken glass pieces.

2. The gas fire of claim 1 wherein the tempered glass is baked three times in a controlled temperature oven, in which the oxygen content and time are also controlled to produce a tempered glass, which breaks into rounded-edged pieces of approximately the same size, and which rounded-edged pieces resist discoloration.

3. The gas fire of claim 1, further including a remote controlled valve in the gas pipe.

4. The gas fire of claim 1 wherein the two rows of openings are formed, offset from each other and spaced apart approximately 90° on a top surface of the at least one gas pipe.

5. The gas fire of claim 4, further including a plurality of gas pipes having two rows of openings thereon.

6. The gas fire of claim 4 wherein the at least one gas pipe is formed in a selected shape.

7. The gas fire of claim 6 wherein the broken glass pieces are washed and sifted to remove debris and slivers.

8. The gas fire of claim 7 wherein the broken glass pieces have been polished to remove any sharp edges.

9. A method of producing a glass fire, comprising the steps of:

forming tempered glass by baking the tempered glass three times in an oven while controlling the oxygen content, temperature and time;

breaking the formed tempered glass into substantially equal smooth-edged pieces;

forming at least one gas pipe with two rows of offset holes approximately 90° apart to burn gas in a cleaner and hotter manner;

tightly packing the substantially equal smooth-edged pieces of tempered glass on a supporting surface in a fireplace around the at least one gas pipe, so as to form a bed of glass therearound; and forming soot-free flames by burning gas from the two rows of offset holes in the at least one gas pipe.

10. The method of claim 9, including the further step of forming the at least one gas pipe in a selected shape to produce a fire having a selected configuration.

11. The method of claim 10, including the further step of providing a plurality of gas pipes having two rows of openings therein to more cleanly burn gas in the substantially equal smooth-edged pieces of tempered glass tightly packed around the plurality of gas pipes.

12. The method of claim 9, including the further step of securing mirrors in the fireplace, around the substantially equal round pieces of tempered glass to produce further reflections and sparkles from any soot-free flames produced.

13. A gas fire, comprising:

a fireplace having a base;

at least one gas pipe having two rows of offset holes formed in a "v", approximately 90° apart on a top surface of the at least one gas pipe, held in the fireplace above the base; and a bed of broken, substantially equal in size, smooth-edged pieces of glass formed from tempered glass that has been baked three times and subject to sudden surface cooling supported by the base, tightly packed around and completely enclosing the at least one gas pipe to form soot-free flames that will not change the color or appearance of the bed of broken, substantially equal in size, smooth-edged pieces of glass.

14. The gas fire of claim 13, further including a plurality of gas pipes having two rows of offset holes formed in a "v" to cleanly burn gas in the fireplace.

15. The gas fire of claim 13, further including a remote control operated valve in the at least one gas pipe to control the flow of oxygen to gas in the at least one gas pipe, and wherein the at least one gas pipe is formed in the shape of a selected design, to produce soot-free flames in a desired arrangement, when cleanly burning gas in the bed of broken, substantially equal in size, smooth-edged pieces of glass.

16. The gas fire of claim 15, further including at least one wall in the fireplace and mirrors secured to the at least one rear wall to enhance the effect of soot-free flames burning over a substantially flat top surface of the bed of broken, substantially equal in size, smooth-edged pieces of glass in the fireplace.

17. The gas fire of claim 13 wherein the tempered glass is baked three times in a controlled temperature oven, in which the oxygen content and time are also controlled to produce a tempered glass, which breaks into rounded-edged pieces of approximately the same size, and which rounded-edged pieces resist discoloration.

* * * * *